US009878882B2

(12) United States Patent
Zhu et al.

(10) Patent No.: US 9,878,882 B2
(45) Date of Patent: Jan. 30, 2018

(54) LARGE-TONNAGE SLENDER EXTERNALLY POWERED CURVE RAIL-MOUNTED UNLOADING SKIP

(71) Applicants: XUZHOU COAL MINE SAFETY EQUIPMENT MANUFACTURE CO., LTD., Jiangsu (CN); CHINA UNIVERSITY OF MINING AND TECHNOLOGY, Jiangsu (CN)

(72) Inventors: Zhencai Zhu, Jiangsu (CN); Gongbo Zhou, Jiangsu (CN); Changhua Hu, Jiangsu (CN); Guohua Cao, Jiangsu (CN); Wei Li, Jiangsu (CN); Guoan Chen, Jiangsu (CN); Yuxing Peng, Jiangsu (CN); Qingyong Du, Jiangsu (CN); Miao Wang, Jiangsu (CN)

(73) Assignees: Xuzhou Coal Mine Safety Equipment Manufacture Co., Ltd., Jiangsu (CN); China University of Mining and Technology, Jiangsu (CN)

( * ) Notice: Subject to any disclaimer, the term of this patent is extended or adjusted under 35 U.S.C. 154(b) by 0 days.

(21) Appl. No.: 14/647,671

(22) PCT Filed: Mar. 26, 2014

(86) PCT No.: PCT/CN2014/074090

§ 371 (c)(1),
(2) Date: May 27, 2015

(87) PCT Pub. No.: WO2015/074358

PCT Pub. Date: May 28, 2015

(65) Prior Publication Data

US 2015/0368072 A1 Dec. 24, 2015

(30) Foreign Application Priority Data

Nov. 25, 2013 (CN) ..... 2013 1 0598737

(51) Int. Cl.
*B66B 17/08* (2006.01)
*B66B 17/26* (2006.01)
*B66B 17/32* (2006.01)

(52) U.S. Cl.
CPC ..... *B66B 17/08* (2013.01); *B66B 17/26* (2013.01); *B66B 17/32* (2013.01)

(58) Field of Classification Search
CPC ..... B66B 17/08; B66B 17/26; B66B 17/32
See application file for complete search history.

(56) References Cited

U.S. PATENT DOCUMENTS 1,071,096 A * 8/1913 Schraeder ..... B66B 17/26 193/21
1,304,784 A * 5/1919 Lepley ..... B66B 17/26 414/658

(Continued)

FOREIGN PATENT DOCUMENTS

CN 2175749 Y 8/1994
CN 101475120 A * 7/2009

(Continued)

OTHER PUBLICATIONS

International Search Report dated Aug. 27, 2014 from International Patent Application No. PCT/CN2014/074090 filed Mar. 26, 2014.

(Continued)

*Primary Examiner* — Anna Momper
*Assistant Examiner* — Ashley Romano
(74) *Attorney, Agent, or Firm* — Sunstone IP

(57) ABSTRACT

The present invention provides a large-tonnage slender externally powered rail-mounted unloading skip, comprising an upper bin body and a lower bin body that are respectively formed by an inner lining plate and an outer plate fixed together via a number of pin shafts, a self-locking gate, and a gate opening device. A loading opening and a (Continued)

coal baffle plate that is used to block coal when the coal is loaded are arranged on the upper part of the upper bin body, a self-locking gate composed of a sector gate plate and unloading rollers is arranged on the lower bin body, a coal chute is arranged on the lower part of the self-locking gate, the upper bin body and the lower bin body are connected together through flanged connection, and channel irons are welded around the walls of the upper bin body and lower bin body respectively; when the skip is at an unloading position, externally powered telescopic push rods push the unloading rollers to move in an unloading rail of the slide block, so that the self-locking gate is opened, and the coal is unloaded along a coal chute. With the reliable connection between the upper bin body and the lower bin body, effective and convenient fixing of the lining plate, and reliable opening of the gate, the skip can meet the production requirements of 10-million tonnage large-size shafts.

1 Claim, 6 Drawing Sheets

(56) References Cited

U.S. PATENT DOCUMENTS 1,969,598 A * 8/1934 Durbin ..... B65D 90/54 414/615
2,538,401 A * 1/1951 Wagner ..... B66B 17/26 193/17
2,969,886 A * 1/1961 Lundy ..... B66B 17/26 414/610
2,995,264 A * 8/1961 Thomas ..... B66B 17/26 414/658
3,032,222 A * 5/1962 Card ..... B66B 17/26 414/648
3,052,367 A * 9/1962 Clark ..... B66B 17/26 414/658
3,484,008 A * 12/1969 Leonard ..... B66B 17/26 414/657
3,499,565 A * 3/1970 Borgman ..... B66B 17/26 414/646
3,702,140 A * 11/1972 O'Connor ..... B65D 90/587 414/609
5,122,028 A * 6/1992 Joubert ..... B66B 17/08 414/403

FOREIGN PATENT DOCUMENTS

CN 103588074 A 2/2014
CN 203602197 U 5/2014
WO 2007029211 A2 3/2007

OTHER PUBLICATIONS

Han, Tingwei et al., "Development and Manufacture of the 40t-Large Skip," Coal Mine Machinery, 2003, No. 8, Aug. 31, 2003 (Aug. 31, 2003), pp. 72-73.
Zhao, Jinqi et al., "Improvement on Skip Out-Driving Unloading Device," Plant Maintenance Engineering, 2011, No. 12, Dec. 31, 2011 (Dec. 31, 2011), pp. 47-48, and figure 3.
Sun, Ruhai, "Study on Unloading Method for Large Skip," Mining & Processing Equipment, 2010, No. 5, May 31, 2010 (May 31, 2010), pp. 50-52.

* cited by examiner

LARGE-TONNAGE SLENDER EXTERNALLY POWERED CURVE RAIL-MOUNTED UNLOADING SKIP

FIELD OF THE INVENTION

The present invention relates to a large-tonnage slender externally powered rail-mounted unloading skip, in particular to a powered rail-mounted unloading skip applicable to 10-million tonnage large-size shaft mines

BACKGROUND OF THE INVENTION

Presently, coal mine production is developed towards large scale, high productivity, and high efficiency, and large-tonnage skips are gradually applied for hoisting in shafts; in addition, the skip tonnage and size tends to increase further, in order to meet the demand of production in coal mines. The size of the skip has to be increased in length, owing to the enlargement of the cross section of shaft is limited. As the length of the skip is increased, it is more difficult to produce integrative large-tonnage skips, and the skip production cost is increased severely; in addition, the lining plates in skips suffer severe abrasion under coal impact, and are difficult to replace because the lining plates in the skips of prior art are connected by bolts; moreover, the skip gate opening device may have deformation owing to the variations of skip landing depth. Therefore, existing large-size skips cannot meet the requirement for convenient lining plate replacement, smooth gate opening, and easy processing and assembly in 10-million tonnage large-size shafts.

SUMMARY OF THE INVENTION

Technical Problems

To overcome the drawbacks in the prior art, the present invention provides a large-tonnage skip, which is simple in structure, safe and reliable, easy to produce and install, economic and practical, and can meet the demand for production development towards large scale, high productivity, and high efficiency in coal mines

Technical Solutions

The large-tonnage slender externally powered rail-mounted unloading skip according to the present invention comprises a coal chute, a skip bin body connected to the upper part of the coal chute, a head rope hanging and connecting plate arranged on the top of the skip bin body, and a tail rope hanging and connecting plate arranged on the bottom of the coal chute, wherein, the skip bin body comprises an upper bin body and a lower bin body connected together, and channel-steel bars are welded at an interval around the walls of the upper bin body and lower bin body; a coal baffle plate is arranged at an upper opening of the upper bin body, a self-locking gate and a gate opening device are arranged above the coal chute and positioned at a lower opening of the lower bin body, the self-locking gate comprises sector gate plates and unloading rollers, and the unloading rollers are welded below the symmetrical center line of the sector gate plates; the gate opening device comprises telescopic push rods fixed to the shaft mouth and a slide block connected to one end of the telescopic push rods.

The skip bin body comprises an inner lining plate and an outer plate, a plurality of pin shafts fix to the inner lining plate are arranged on the outer plate, and each of pin shafts has a pin bolt fixed to the outer plate.

The slide block comprises a rectangular plate frame and an unloading rail fixedly connected to one side of the plate frame, wherein, four rollers with U-shaped groove are arranged at the four corners of the plate frame respectively, and upper and lower ∩-shaped guide rails designed to constrain the rollers to move left and right in horizontal direction are arranged at the upper end and lower end of the plate frame respectively.

Beneficial Effects

With the reliable connection between the upper bin body and the lower bin body, effective and convenient fixing of the lining plate, and reliable opening of the gate, the large-tonnage skip according to the present invention can meet the production requirements of 10-million tonnage large-size shafts. The major advantages include:

(1) Since the upper bin body and the lower bin body are separated from each other, and flanged connection are applied the skip is easy to produce, transport, and install;

(2) The inner lining plate is fixed by pin shafts to avoid making holes in the lining plate; in addition, since the inner lining plate and the outer plate are fixedly connected together by pin bolts, the lining plate can be replaced easily;

(3) Since the skip employs externally powered telescopic push rods and a rail-mounted unloading slide block for unloading operation, it incorporates the quick unloading feature of a curve rail-mounted unloading mechanism and the small shock feature of an externally powered unloading mechanism; thus, unloading safety and reliability are ensured.

Figure 1:
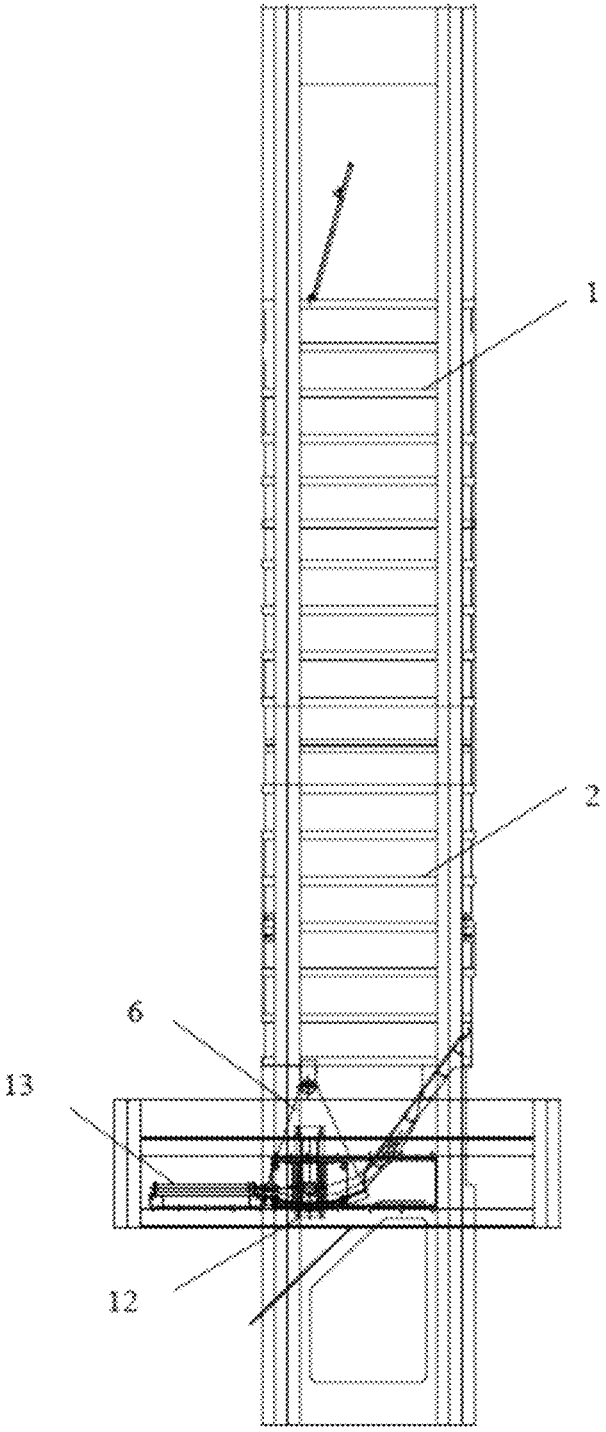
FIG. 1 is an overall schematic structural diagram of the large-tonnage slender externally powered rail-mounted unloading skip according to the present invention.

Among the figures: 1—upper bin body, 2—lower bin body, 3—head rope hanging and connecting plate, 4—coal baffle plate, 5—flange, 6—self-locking gate, 6-1—sector gate plate, 6-2—unloading roller, 7—coal chute, 8—tail rope hanging and connecting plate, 9—channel iron, 10-1—inner lining plate, 10-2—outer plate, 11—pin shaft, 11-1—pin bolt, 12—slide block, 12-1—unloading rail, 12-2—plate frame, 12-3—roller, 12-4—upper ∩-shaped guide rail, 12-5—lower ∩-shaped guide rail, 13—telescopic push rod.

DETAILED DESCRIPTION OF THE EMBODIMENTS

Hereafter the present invention will be further detailed in an embodiment, with reference to the accompanying drawings:

The large-tonnage slender externally powered rail-mounted unloading skip according to the present invention mainly comprises a skip bin body, a head rope hanging and connecting plate 3, a self-locking gate 6, a coal chute 7, a tail rope hanging and connecting plate 8, and a gate opening device. The skip bin body is arranged above the coal chute 7, the head rope hanging and connecting plate 3 is arranged on the top of the skip bin body, the tail rope hanging and connecting plate 8 is arranged on the bottom of the coal chute 7, and the head rope hanging and connecting plate 3 and tail rope hanging and connecting plate 8 are used to connect a hoisting steel wire rope. The skip bin body is formed by an upper bin body 1 and a lower bin body 2 connected together, and comprises an inner lining plate 10-1 and an outer plate 10-2, a plurality of pin shafts 11 fixed to the inner lining plate 10-1 are arranged on the outer plate 10-2, and each pin shaft 11 has a pin bolt 11-1 fixed to the outer plate 10-2. Channel-steel bars 9 are welded around the outer wall of the upper bin body 1 and the wall of the lower bin body 2 at intervals respectively; a coal baffle plate 4 is arranged at an upper opening of the upper bin body 1, a self-locking gate 6 and a gate opening device are arranged at an lower opening of the lower bin body 2 and above the coal chute 7, the self-locking gate 6 comprises a sector gate plate 6-1 and unloading rollers 6-2, and the unloading rollers 6-2 are welded below the symmetrical center line of the sector gate plates 6-1; the gate opening device comprises telescopic push rods 13 fixed to the shaft mouth and a slide block 12 connected to the end of the telescopic push rods 13. The slide block 12 comprises a rectangular plate frame 12-2 and an unloading rail 12-1 fixedly connected to one side of the plate frame 12-2, wherein, four rollers 12-3 with U-shaped groove are arranged at the four corners of the plate frame 12-2 respectively, and upper and lower ∩-shaped guide rails 12-4 and 12-5 designed to constrain the rollers 12-3 to move left and right in horizontal direction are arranged at the upper end and lower end of the plate frame 12-2 respectively.

Figure 2:
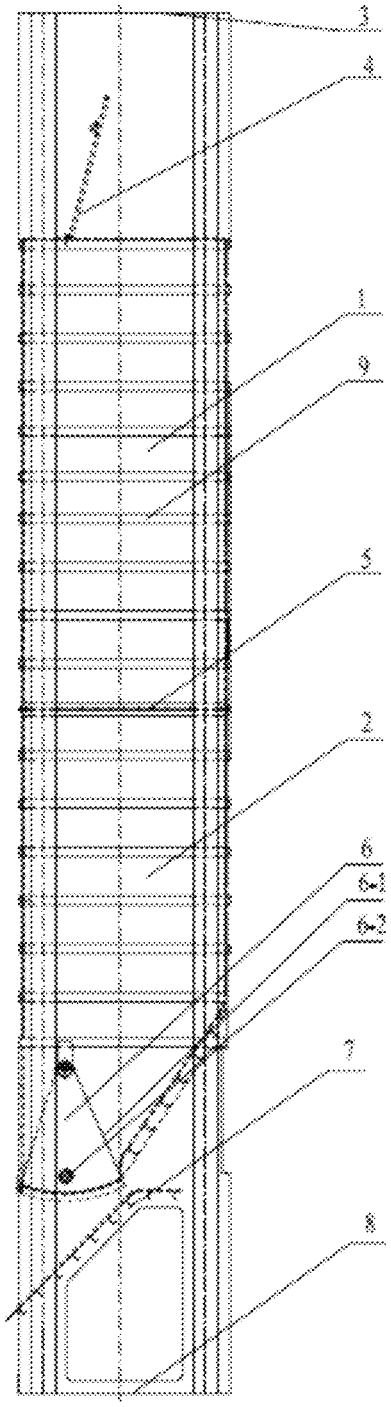
FIG. 2 is a front view of the large-tonnage slender externally powered rail-mounted unloading skip according to the present invention.
Figure 3:
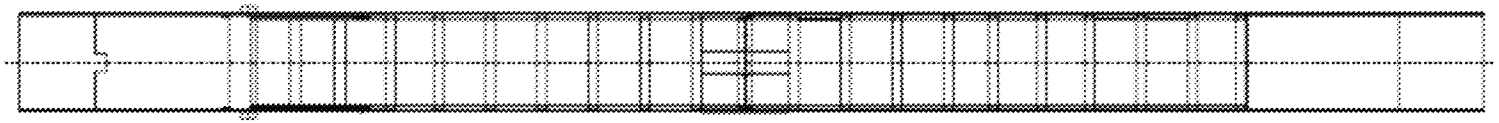
FIG. 3 is a side view of the large-tonnage slender externally powered rail-mounted unloading skip according to the present invention.

FIG. 2 and FIG. 3 are front view and side view of the large-tonnage slender externally powered rail-mounted unloading skip, respectively. As shown in FIG. 2 and FIG. 3, the head rope hanging and connecting plate 3 connected to a hoisting steel wire rope is arranged on the top of the skip, and a loading opening and the coal baffle plate 4 designed to block the coal are arranged below the head rope hanging and connecting plate 3; the coal enters into the skip bin through the loading opening; the skip bin body consists of an upper bin body 1 and a lower bin body 2, which are connected together through flanged connection; channel irons 9 are welded around the skip bin to reinforce the skip bin; an unloading opening is arranged on the lower part of the lower bin body 2, the self-locking gate 6 is mounted at the unloading opening, the coal chute 7 is arranged below the unloading opening, and the tail rope hanging and connecting plate 8 connected to a tail rope is arranged below the coal chute 7.

Figure 4:
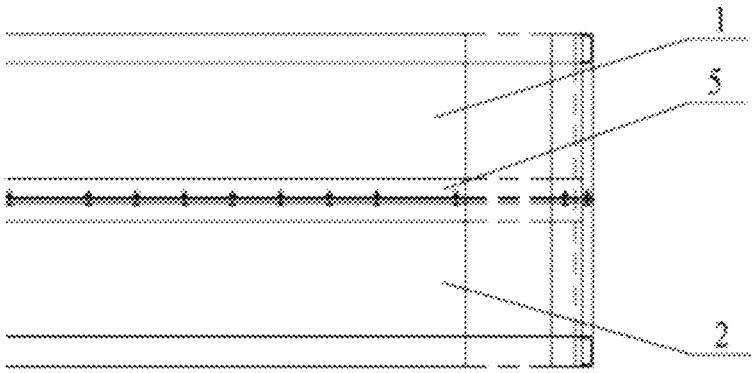
FIG. 4 shows the flanged connection structure between the upper bin body and the lower bin body of the skip according to the present invention.
Figure 5:
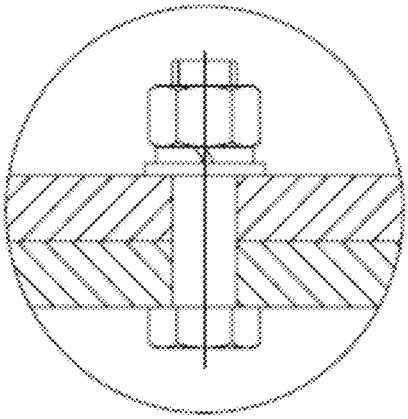
FIG. 5 is a partial enlarged view of the flanged connection shown in FIG. 4.

FIG. 4 shows the structure representation of flanged connection between the upper bin body and the lower bin body of the skip, wherein, the bottom of the upper bin body 1 is connected to the top of the lower bin body 2 via a flange 5 that has a number of bolt holes; bolts passes through the holes in the flange 5 and connect the upper bin body 1 and the lower bin body 2 together, as shown in FIG. 5.

Figure 6:
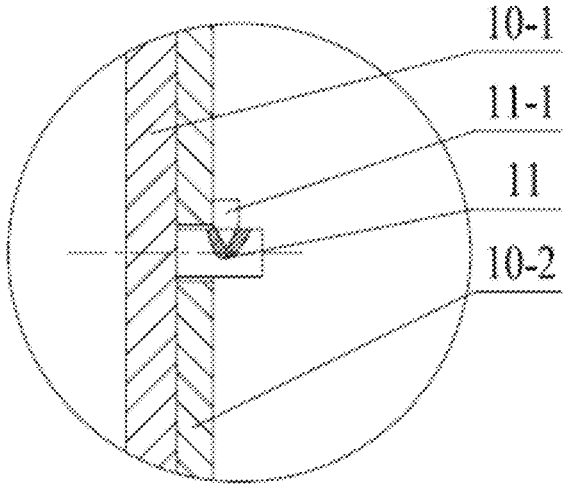
FIG. 6 is a partial enlarged view of front view of the connection between the inner lining plate and the outer plate of the skip according to the present invention.
Figure 7:
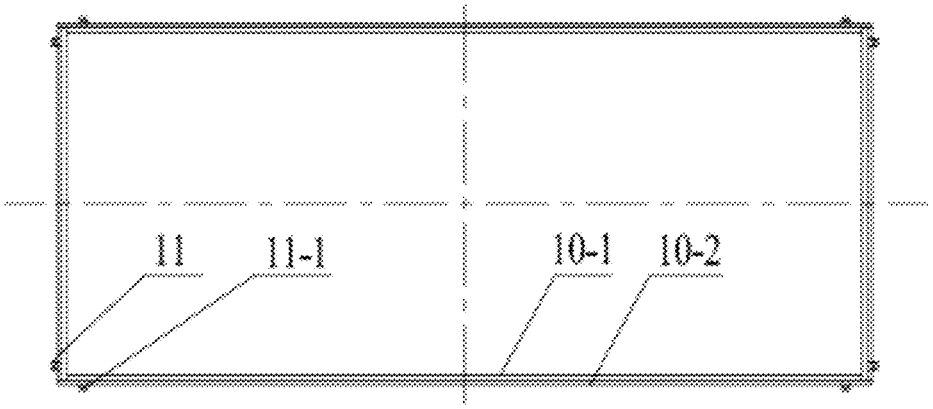
FIG. 7 is a top view of the connection between the inner lining plate and the outer plate of the skip according to the present invention.

FIG. 6 and FIG. 7 show the connection between the inner lining plate and the outer plate of the skip. The wall of the skip bin body consists of two plate layers, i.e., the inner lining plate 10-1 and the outer plate 10-2, wherein, a number of pin shafts 11 are welded on the edge of the inner lining plate 10-1, holes matching the pin shafts 11 on the inner lining plate 10-1 are arranged in sequence on the outer plate 10-2, the pin shafts 11 pass through the holes on the outer plate 10-2 of the skip, and the pin bolts 11-1 arranged at the ends of the pin shafts 11 connect the inner lining plate 10-1 and the outer plate 10-2 together.

Figure 8:
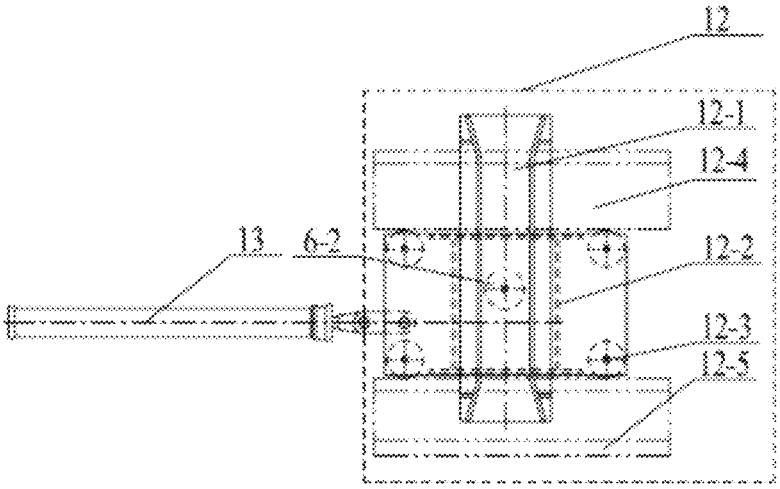
FIG. 8 is a connection representation of the gate opening device according to the present invention.

FIG. 8 shows the connection of the gate opening device, wherein, the telescopic push rods 13 are fixed to the shaft mouth, and the slide block 12 is connected to the end of the telescopic push rods 13; the slide block 12 comprises a rectangular plate frame 12-2 and an unloading rail 12-1 fixedly connected to one side of the plate frame 12-2, wherein, four rollers 12-3 with U-shaped groove are arranged at the four corners of the plate frame 12-2 respectively, and upper and lower ∩-shaped guide rails 12-4 and 12-5 designed to constrain the rollers 12-3 to move left and right in horizontal direction are arranged at the upper end and lower end of the plate frame 12-2 respectively.

When the unloading skip is on the bottom of a shaft to load coal, the coal is loaded by a coal distributor of a measure hopper. The coal enters into the skip bin through the loading opening of the skip, while the self-locking gate 6 locks up automatically; after the skip bin is fully filled with coal, the skip is lifted up by a steel wire rope to the shaft mouth to unload coal. In the hoisting process of the skip, the self-locking gate 6 keeps in self-locked state under the pressure of the coal, and will not unlock. When the unloading process starts, the unloading rollers 6-2 on the self-locking gate 6 of the skip enter into the unloading rail 12-1, and the telescopic push rods 13 start to push the slide block 12 to move in horizontal direction; as the skip is hoisted up further, the unloading rollers 6-1 move upwards and horizontally in the unloading rail 12-1; thus, the self-locking gate 6 unlocks, the sector gate plate 6-1 is opened, and the coal is unloaded. The coal in the skip bin is unloaded through the unloading opening along the coal chute 7, till all coal is unloaded. Then, the telescopic push rods 13 retract, the skip moves downwards, and the self-locking gate 6 locks up; finally, the skip moves to the bottom of the shaft, and a next operating cycle can start.

The invention claimed is:

1. A large-tonnage slender externally powered rail-mounted unloading skip, comprising:

a coal chute;

a gate opening device that is located at a shaft mouth and includes telescopic push rods fixed at the two sides of the shaft mouth and a slide block connected to the end of the telescopic push rods;

a skip bin body connected to the upper part of the coal chute;

a head rope hanging and connecting plate positioned on the top of the skip bin body, and a tail rope hanging and connecting plate positioned on the bottom of the coal chute, wherein the skip bin body comprises an upper bin body and a lower bin body connected together, and channel irons are welded at an interval around the walls of the upper bin body and lower bin body;

wherein a coal baffle plate is located at an upper opening of the upper bin body, and a self-locking gate is located above the coal chute and positioned at a lower opening of the lower bin body;

wherein the self-locking gate comprises sector gate plates and unloading rollers, and the unloading rollers are welded below a symmetrical center line of the sector gate plates, wherein the skip bin body comprises an inner lining plate and an outer plate, and a plurality of pin shafts are fixed to the inner lining plate and arranged on the outer plate, and each pin shaft has a pin bolt fixed to the outer plate;

wherein the slide block comprises:

a rectangular plate frame and an unloading rail fixedly connected to one side of the plate frame, four rollers arranged at the four corners of the plate frame respectively, and upper and lower guide rails arranged at the upper end and lower end of the plate frame respectively, wherein the upper and lower guide rails constrain movement of the rollers to a horizontal direction thereby allowing movement of the rollers in a horizontal direction and restricting movement of the rollers in a vertical direction;

wherein, when the unloading skip is configured such that when it is on the bottom of a shaft to load coal, the coal is loaded by a coal distributor of a measure hopper and the coal enters into the skip bin through a loading opening of the skip, while the self-locking gate locks up automatically;

wherein, the unloading skip is further configured such that after the skip bin is fully filled with coal, the skip is structurally in a condition to be hoisted up by a steel wire rope to the shaft mouth to unload coal, such that, in the hoisting process of the skip, the self-locking gate remains in a self-locked state under the pressure of the coal, and will not unlock;

wherein, the unloading rollers on the self-locking gate of the skip are configured to enter into the unloading rail when an unloading process starts, and the telescopic push rods are configured to start to push the slide block to move in a horizontal direction;

wherein, the unloading rollers are configured to move upwards and horizontally in the unloading rail, when the skip is hoisted up;

wherein the self-locking gate is configured to unlock, and the sector gate plate is configured to open and facilitate coal unloading through the unloading opening along the coal chute, until all coal is unloaded;

wherein, the telescopic push rods are configured to retract and thereby facilitate downward movement of the skip; and wherein the self-locking gate is configured to lock up and facilitate a next operating cycle, when the skip is moved to the bottom of the shaft.

* * * * *